US007503828B2

(12) United States Patent
Lee

(10) Patent No.: US 7,503,828 B2
(45) Date of Patent: Mar. 17, 2009

(54) REMOTE-CONTROLLED MOTORCYCLE AND METHOD OF COUNTER-STEERING

(75) Inventor: Chun Wah Lee, Tsang Kwan O (HK)

(73) Assignee: Mattel, Inc., El Segundo, CA (US)

( * ) Notice: Subject to any disclaimer, the term of this patent is extended or adjusted under 35 U.S.C. 154(b) by 285 days.

(21) Appl. No.: 11/257,378

(22) Filed: Oct. 24, 2005

(65) Prior Publication Data

US 2006/0121824 A1 Jun. 8, 2006

Related U.S. Application Data

(60) Provisional application No. 60/622,205, filed on Oct. 26, 2004, provisional application No. 60/642,466, filed on Jan. 7, 2005, provisional application No. 60/696,498, filed on Jul. 1, 2005.

(51) Int. Cl.
*A63H 17/00* (2006.01)

(52) U.S. Cl. ..... 446/465; 446/460; 446/440

(58) Field of Classification Search ..... 446/460, 446/440, 456, 454, 436, 465
See application file for complete search history.

(56) References Cited

U.S. PATENT DOCUMENTS

| | | | | |
|---|---|---|---|---|
| 2,742,735 | A * | 4/1956 | Sommerhoff | 446/456 |
| 3,016,967 | A | 1/1962 | Rehfeld | |
| 3,733,739 | A | 5/1973 | Terzian | |
| 3,751,851 | A | 8/1973 | Nagal | |
| 3,785,086 | A | 1/1974 | Escobedo | |
| 3,878,521 | A * | 4/1975 | Licitis et al. | 446/454 |
| 4,201,011 | A | 5/1980 | Cook | |
| 4,267,663 | A | 5/1981 | Nagahara | |
| 4,290,228 | A | 9/1981 | Goldfarb et al. | |
| 4,327,517 | A | 5/1982 | Schwager | |
| 4,342,175 | A | 8/1982 | Cernansky et al. | |
| 4,366,645 | A | 1/1983 | Crain et al. | |
| 4,383,388 | A | 5/1983 | Suimon | |
| 4,385,466 | A | 5/1983 | ReVelle | |
| 4,387,532 | A | 6/1983 | Suimon | |
| 4,563,164 | A | 1/1986 | Tao | |
| 4,601,674 | A | 7/1986 | Koizumi | |
| 4,693,696 | A | 9/1987 | Buck | |
| 4,832,651 | A | 5/1989 | Buck | |

(Continued)

OTHER PUBLICATIONS

1996 Mattel Catalog, p. 165.

(Continued)

*Primary Examiner*—Gene Kim
*Assistant Examiner*—Urszula M Cegielnik
(74) *Attorney, Agent, or Firm*—Panitch Schwarze Belisario & Nadel LLP

(57) ABSTRACT

A remote-controlled toy motorcycle includes a chassis supported by oversized front and rear tires for increased stability, and a chassis-mounted rider figure having rotating members for contacting a ground surface to prevent excessive wear of the rider figure legs and also to allow the toy motorcycle to self-start from a leaning position. "Counter-steering" is simulated by actuating a steering servo to initially turn a front wheel from a straight original direction to a direction opposite the desired turn direction. The front wheel is held momentarily while the toy motorcycle destabilizes and leans in the turn direction. Then, the steering servo is automatically actuated to turn the front wheel in the desired turn direction.

7 Claims, 7 Drawing Sheets

U.S. PATENT DOCUMENTS

| | | | |
|---|---|---|---|
| 4,902,271 | A | 2/1990 | Yoneda |
| 4,903,790 | A | 2/1990 | Horiike et al. |
| 4,966,569 | A | 10/1990 | Asano |
| 5,368,516 | A | 11/1994 | Hoeting et al. |
| 5,397,260 | A | 3/1995 | Tilbor et al. |
| 5,503,244 | A | 4/1996 | Beirlein |
| 5,684,244 | A | 11/1997 | Jones |
| 5,709,583 | A | 1/1998 | Suto et al. |
| 5,762,351 | A | 6/1998 | SooHoo |
| 5,811,656 | A | 9/1998 | Jones |
| 5,813,684 | A | 9/1998 | Baron |
| 5,820,439 | A | 10/1998 | Hair, III |
| 5,882,241 | A | 3/1999 | Mullaney et al. |
| 5,919,072 | A | 7/1999 | Pohlman |
| 5,919,075 | A | 7/1999 | George et al. |
| 6,095,891 | A | 8/2000 | Hoeting et al. |
| 6,095,892 | A | 8/2000 | Moe |
| 6,120,345 | A | 9/2000 | Lenihan et al. |
| 6,238,017 | B1 | 5/2001 | Eitel |
| 6,350,171 | B1 | 2/2002 | Hippely et al. |
| 6,446,501 | B1 | 9/2002 | Domeck et al. |
| 6,482,069 | B1 | 11/2002 | Tilbor et al. |
| 6,540,583 | B1 | 4/2003 | Hoeting et al. |
| 6,551,169 | B2 | 4/2003 | Jaffe |
| 6,626,116 | B2 | 9/2003 | Clark, Jr. et al. |
| 6,648,722 | B2 | 11/2003 | Lynders et al. |
| 6,648,723 | B2 | 11/2003 | Clark, Jr. et al. |
| 6,656,010 | B1 | 12/2003 | Bienz et al. |
| 6,682,394 | B2 | 1/2004 | Tilbor et al. |
| 6,692,333 | B2 | 2/2004 | Kislevitz et al. |
| 6,729,933 | B2 | 5/2004 | Hoeting et al. |
| 6,755,265 | B2 | 6/2004 | Huntsberger et al. |
| 6,780,077 | B2 | 8/2004 | Baumgartner et al. |
| 6,786,796 | B2 | 9/2004 | Suto |
| 6,854,547 | B2 | 2/2005 | Moll et al. |
| D514,630 | S | 2/2006 | Tilbor |
| 6,994,179 | B2 | 2/2006 | Huntsberger et al. |
| 7,288,017 | B2 | 10/2007 | Mukaida |
| 7,291,053 | B2 | 11/2007 | Mukaida |

OTHER PUBLICATIONS

*Counter Steering*, James R. Davis 1992-2003© by The Master Strategy Group.

www.motorcyclelinks4u.co.uk/target_docs/tech_corner_part2.htm Motorcycle Tech Corner 2 by Ed Green, Dec. 15, 2004.

* cited by examiner

REMOTE-CONTROLLED MOTORCYCLE AND METHOD OF COUNTER-STEERING

CROSS-REFERENCE TO RELATED APPLICATIONS

This application claims benefit of: U.S. Provisional Patent Application No. 60/622,205, "REBOUND MOTORCYCLE", filed Oct. 26, 2004; U.S. Provisional Patent Application No. 60/642,466 "REBOUND SUPER BIKE", filed Jan. 7, 2005; and U.S. Provisional Patent Application No. 60/696,498, "REMOTE-CONTROLLED MOTORCYCLE AND METHOD OF COUNTER-STEERING", filed Jul. 1, 2005, all incorporated by reference.

FIELD OF THE INVENTION

The present invention relates generally to toy vehicles, and, more particularly, to remotely controlled, two-wheeled toy vehicles like motorcycles.

BACKGROUND OF THE INVENTION

Remote controlled, two-wheeled toys vehicles (i.e., motorcycles, motorbikes and scooters) are generally known. Among them are self-righting remote controlled motorcycles that maintain stability by having a wider tire in the rear. Although stability is increased, such motorcycles have difficulty staying upright at low speeds unless aided by an on-board gyroscope.

There also exists toy motorcycles having side supports to support the toy motorcycle in the extreme lateral leaning positions. For example, U.S. Pat. No. 4,601,674 discloses projecting portions formed from synthetic resin material. Such projecting portions are susceptible to constant wear and it is likely that the projecting portions would likely wear out over time.

Various steering mechanisms are also generally known for toy motorcycles. Known steering mechanisms generally include rotational members that transfer torque to the front fork of the toy motorcycle to turn the front fork and front wheel in a desired direction of travel. Thus, known steering mechanisms only operate in basic steering functions.

Consumers today, especially those that play with dynamic toys such as remote controlled motorcycles, desire realistic effects. "Counter-steering," for example, is a method of steering a real motorcycle at road speed by controllably leaning the motorcycle. The rider initiates a turn by applying a force to the handle bars to momentarily push the handle (and the fork) in a direction opposite the desired turn direction, i.e., away from the desired turn. During this time, the motorcycle destabilizes and begins to fall in the desired turn direction due to the overall weight shifting of the motorcycle caused by the front wheel veering away from its original path of motion. At some point the rider is sufficiently tipped that he can bring the wheel around into the direction of the turn. According to some, this counter-steering method is required to steer virtually all full sized motorcycles at road speed. However, it is difficult to do this with a remotely controlled motorcycle for a variety of reasons.

It would be desirable to have a remote controlled toy vehicle capable of self-righting and staying upright even at low speeds. Furthermore, it would also be desirable to have a steering mechanism capable of simulating counter-steering.

BRIEF SUMMARY OF THE INVENTION

In one aspect, the present invention is a toy vehicle comprising: a chassis; a front wheel supported for rotation from the chassis and a rear wheel supported for rotation from the chassis in line with the front wheel so as to define a central vertical longitudinal plane bisecting each of the front and rear wheels, each of the front and rear wheels being supported from the chassis for rotation at least about central axis of each respective wheel extending transversely to the central vertical longitudinal plane; a motor supported from the chassis and coupled with one of the front and rear wheels as a propulsion wheel so as to rotate at least the propulsion wheel to propel the toy vehicle; and a rider figure on the chassis, the rider figure having legs extending down opposite lateral sides of the chassis and including a rotating member exposed at a lowermost part of each leg along the lateral side of the chassis so as to contact and roll over a surface and support the toy in an extreme lateral side leaning position on the surface simultaneously with the front and rear wheels.

In yet another aspect, the present invention is a toy vehicle comprising a chassis; a front wheel supported for rotation from the chassis and a rear wheel supported for rotation in line with the front wheel from the chassis so as to define a central vertical longitudinal plane bisecting each of the front and rear wheels, each of the front and rear wheels being supported from the chassis for rotation about central axis of each respective wheel perpendicular to the central vertical longitudinal plane; a motor supported from the chassis and coupled with a propelling one of the front and rear wheels so as to rotate the propelling one of the wheels to propel the toy vehicle; and a steering servo coupled to at least one steering wheel of the front wheel and the rear wheel of the toy motorcycle; and control means coupled to the steering servo for actuating the servo so as to turn the at least one steering wheel from an original straight direction to a first lateral direction and maintaining the at least one steering wheel in the first lateral direction for less than one second so as to initially destabilize the toy vehicle and for immediately thereafter automatically actuating the steering servo to turn the at least one steering wheel from the first lateral direction to a second lateral direction opposite the first lateral direction and maintaining the one at least steering wheel in the second lateral direction for a period sufficiently greater than one second to turn the motorcycle from the originally straight direction to the second lateral direction.

In yet another aspect, the present invitation is a method of steering a toy vehicle having in-line front and rear wheels to simulate counter-steering in turning from an original straight direction to a direction away from the straight direction comprising the steps: a) actuating a steering servo on the toy vehicle so as to turn one of the front wheel and the rear wheel of the toy vehicle initially from an original straight direction to a first direction and maintaining the one wheel in the first direction for a first time period sufficient to initially destabilize the toy vehicle; and b) immediately thereafter automatically actuating the steering servo to turn the one wheel from the first direction to a second direction laterally opposite the first direction and maintaining the one wheel in the second direction for a second time period greater than the first time period and sufficient to turn the toy vehicle from the originally straight direction to the second direction

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

DETAILED DESCRIPTION OF THE INVENTION

Figure 1:
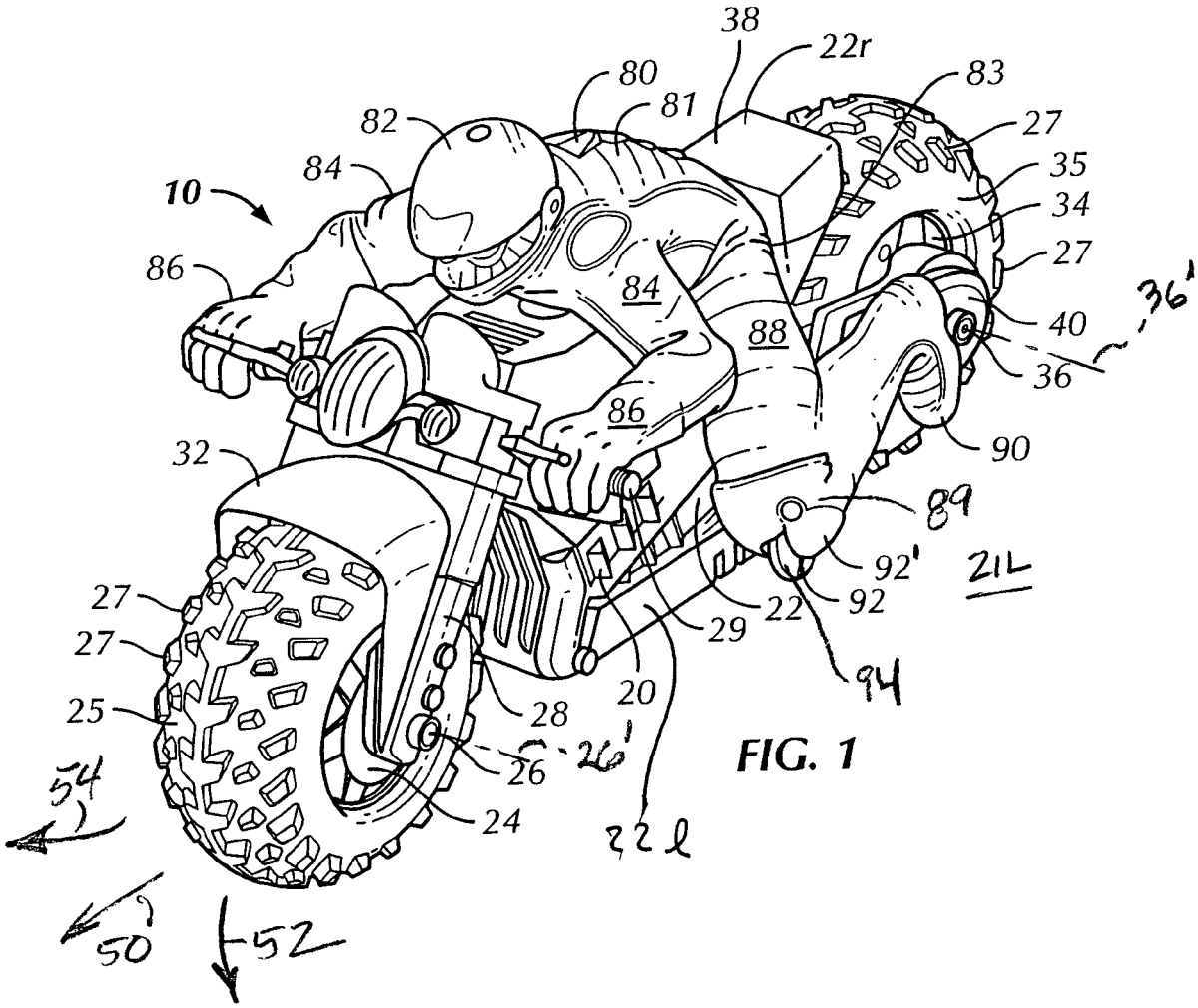
FIG. 1 is a left front perspective view of a toy vehicle in accordance with a presently preferred embodiment of the present invention.
Figure 2:
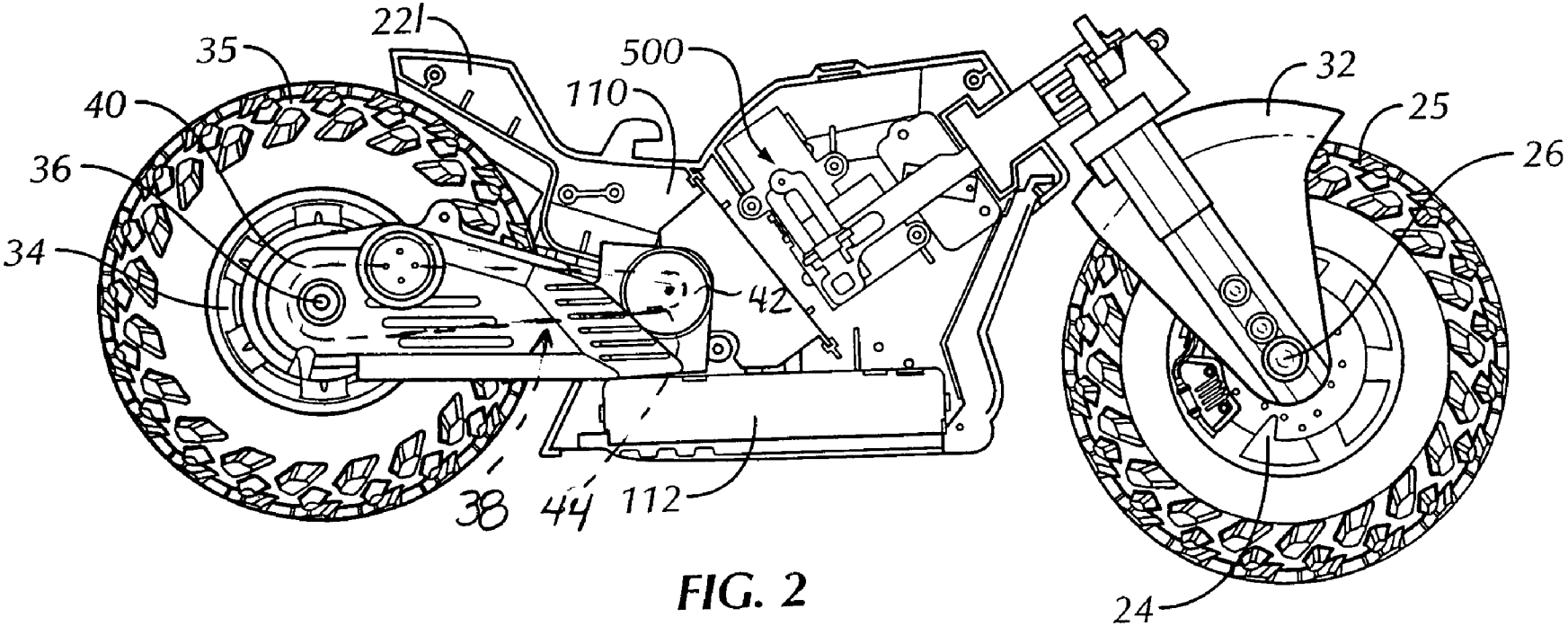
FIG. 2 is a right side elevation view of the toy vehicle of FIG. 1 shown without a right housing.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Figure 6:
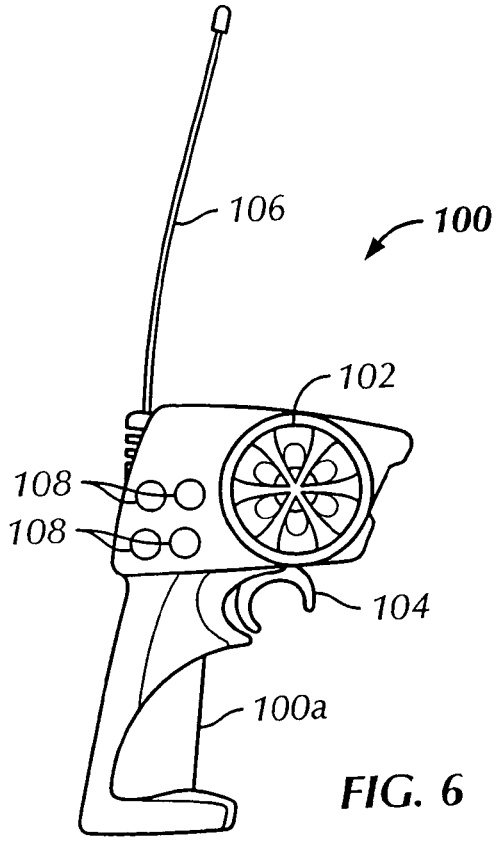
FIG. 6 is a side elevation view of a manually operated, remote controller for controlling the toy vehicle of FIG. 1.
Figure 7:
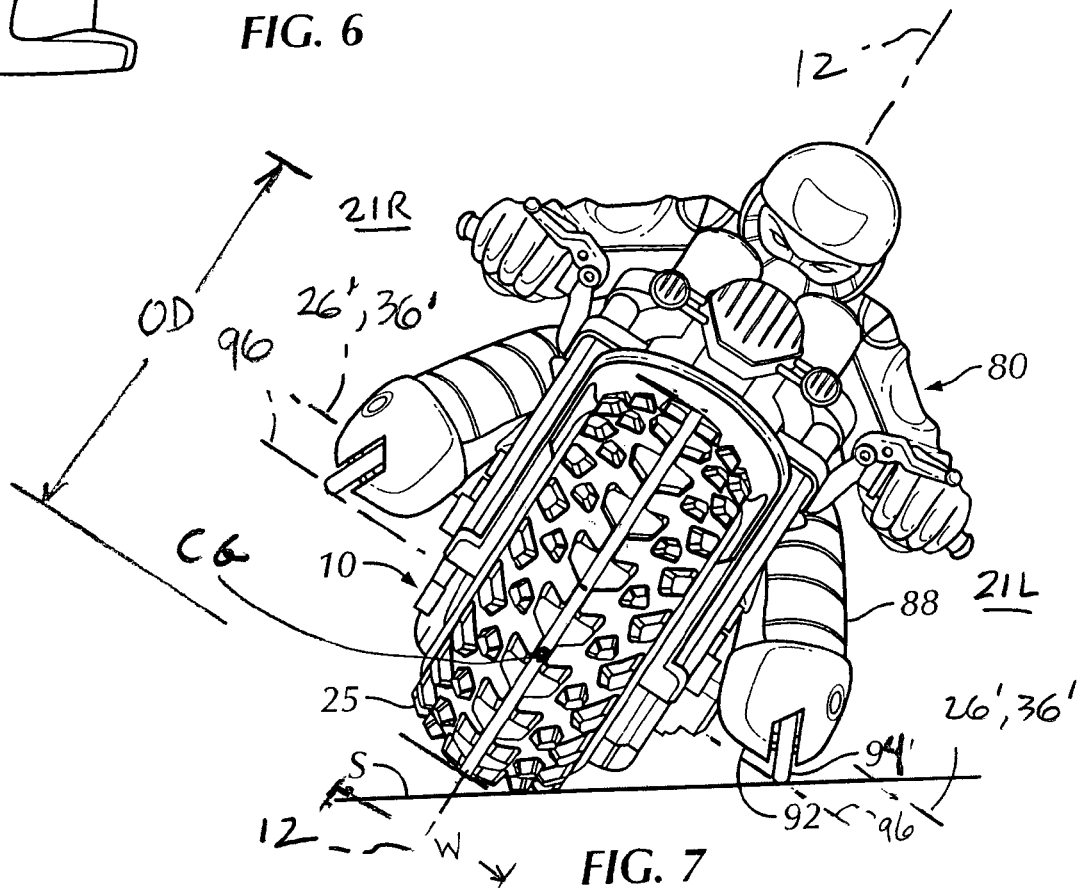
FIG. 7 is a front elevation showing rotating members at lowermost positions of the legs along the lateral sides of the toy vehicle of FIG. 1 and showing the toy vehicle in an extreme leaning position.
Figure 8:
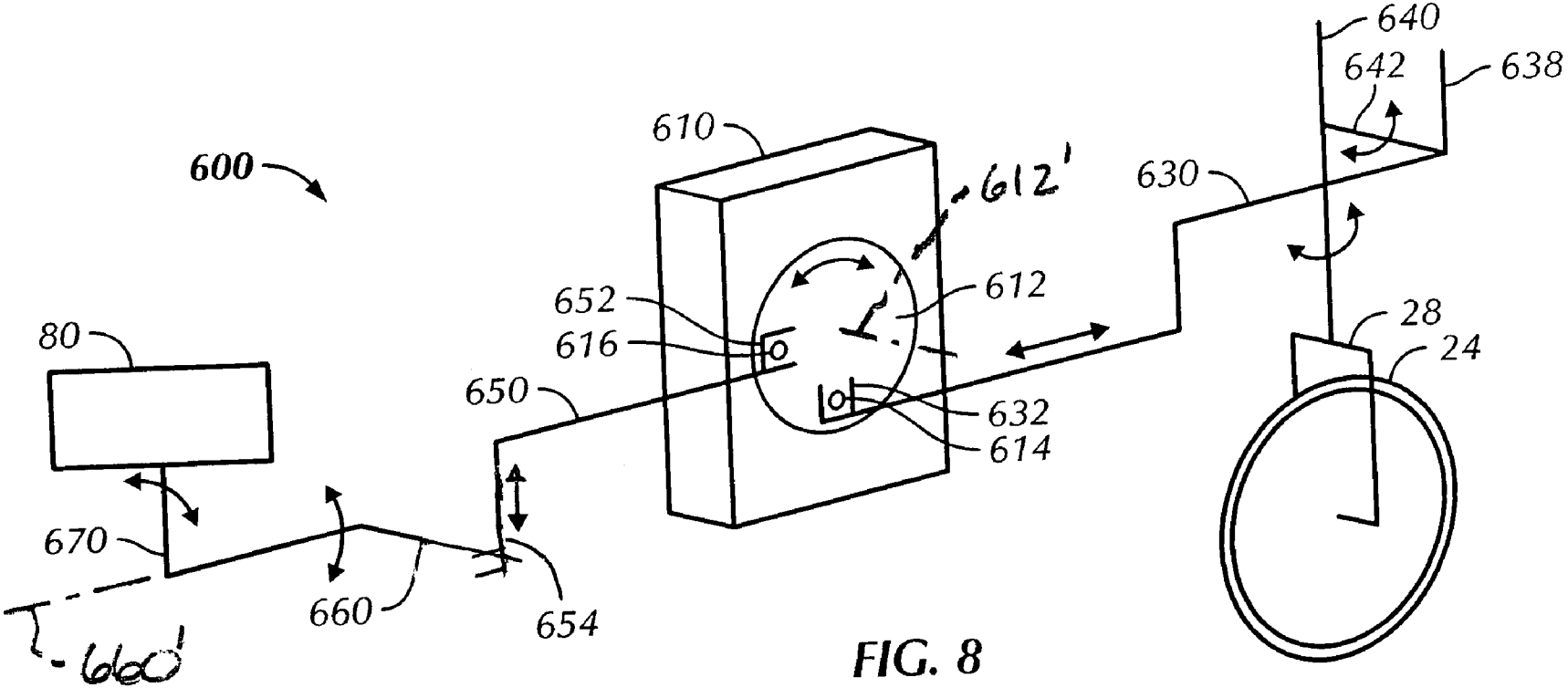
FIG. 8 is a schematic representation of an alternative steering assembly for simultaneously steering a front wheel and pivoting a rider figure of the toy vehicle of FIG. 1.

Referring to the drawings in detail, wherein like numerals indicate like elements throughout, there is shown in FIGS. 1-7 a presently preferred embodiment of a toy vehicle, in particular, a toy motorcycle 10 in accordance with the present invention. FIG. 8 illustrates an alternative steering assembly capable of being used with the toy motorcycle 10 or similar toys.

Referring to FIG. 1, the toy vehicle 10 comprises a vehicle "body" or "chassis" indicated generally at 20 and a single rider figurine (or simply "rider") 80 attached thereto. The "chassis" 20 may be the frame of a true frame and body construction or a combined frame and body housing of monocoque construction such as a housing formed by mating together half shells as in the present case. Although it is preferable that the vehicle have an exterior made to look like a motorcycle, it is within the spirit and scope of certain aspects of the present invention that the monocoque vehicle chassis/body 20 to be shaped to look like another type of two-wheeled vehicle, for example, a scooter. The depicted vehicle chassis/body 20 is of monocoque construction with a decorated, load bearing main or central housing 22, preferably molded from plastic to replicate the styling of a racing motorcycle. Preferably, the housing 22 is made up of left and right shells **22*l*, 22*r* attached to one another using conventional fasteners such as screws, bolts, rivets, and/or other conventional means of attachment such as staking, adhesives, fusion, etc. Although a mating two-shell monocoque arrangement is preferred, the housing 22 may be of a conventional frame and body construction. Front and rear wheels 24, 26 are supported for rotation from the chassis, the rear wheel 26 being in line with the front wheel 24 so as to define a central vertical longitudinal plane 12 (in FIG. 7) of the chassis 20 bisecting each of the wheel 24, 26 and the vehicle 10**.

A fork 28 is pivotably attached proximate the front of the housing 22, the legs or ends of which extend generally downwardly from proximate the front of the housing 22. A fork 28 with solid ends is preferred but the ends of the fork 28 may be telescopic and have a spring on each side of the fork 28 to allow the sliding movement of the bottom of the fork 28 with respect to the top of the fork 28 so as to act as a front suspension for the toy vehicle 10. A front axle 26 is engaged between the ends of the fork 28 proximate the bottom of its ends. A front wheel 24 is rotatably mounted on the front axle 26 between the ends of the fork 28. Central axis 26' of axle 26 is also the central axis of the front wheel 24 and its axis of rotation. Preferably the front wheel 24 is shaped and sized such that a front tire 25 may be wrapped around the circumferential outer edge of the front wheel 24. A front fender 32 is optional.

A drive mechanism housing 40 (see FIG. 2) is preferably provided attached proximate the rear of the main housing 22. The drive mechanism housing 40 extends rearwardly from its connection point with the housing 22. Engaged through the drive mechanism housing 40 is a rotatable back or rear axle 36. A back or rear wheel 34 is engaged with the back axle 36 so as to be rotated on or rotated by the back axle 36. Central axis 36' of axle 36 is also the central axis of the back wheel 34 and its axis of rotation. The back wheel 34 preferably is shaped and sized such that a back or rear tire 35 may be wrapped around an outer edge of the back wheel 34. In the preferred embodiment, the wheels 24, 34 are constructed of a solid, durable material such as metal. One of ordinary skill in the art would recognize that other materials such as various polymers could be substituted without departing from the spirit and scope of the invention.

The front and back tires 25, 35 are preferably made of a soft polymer such as a soft polyvinyl chloride (PVC) or an elastomer selected from the family of styrenic thermoplastic elastomers polymers sold under the trademark KRAYTON POLYMERS so as to increase traction and improve control of the toy vehicle 10. It is also preferred that the tires 25, 35 are essentially identical in dimension and construction and oversized to provide additional stability for the toy vehicle 10. In the preferred embodiment, the tires 25, 35 are either filled with foam or the tires are hollow and sealed and preferably have a valve for inflating and adjusting the pressure level of the tires 25, 35. One of ordinary skill in the art would recognize that other sizes and materials could be substituted, such as, but not limited to, silicone, polyurethane foam, latex, and rubber. Moreover, the tires could be open to atmosphere or solid. For purposes of the invention, it is preferred that each tire 25, 35 have a maximum axial width ("W") to outer diameter (height) ("OD") ratio of at least 1 to 2 and, in any event, at least about 1 to 3. Stated another way, each tire has an outer diameter to maximum axial width ratio of less than 3 and preferably 2 or less. It is also preferred that each of the tires 25, 35 hold the shape of a torus for increased stability of the toy vehicle 10 such that the toy vehicle 10 is capable of staying upright even at relatively low speeds.

In the preferred embodiment, each of the tires 25, 35 has knobs 27 for gripping and traction, particularly off pavement terrain including but not limited to sand, dirt and grass. Optionally, a spring or other type of shock absorber (not shown) may extend generally upwardly from the top of drive mechanism housing 40, located in front of the back wheel 34. The upper end of the shock absorber may engage with the interior or rear of the housing 22 or chassis 20 just beneath the rider 80. The shock absorber may act as a rear suspension for the toy vehicle 10. A back fender 38 is optional. The vehicle chassis 20 may further include various lights such as, but not limited to, a front light, a rear brake light, and front and/or back turn signals.

The rider 80 is shaped to look like an actual rider of a racing motorcycle. The rider 80 has a head 82, torso 81, mid-section 83, arms 84, hands 86, legs 88, and feet 90. The single rider 80 is seated atop the housing 22 in a generally prone position stretched from the front to the back of the housing 22 at least partially overlapping the front wheel 24 and the rear wheel 34 (and their tires 25, 35) with its legs 88 extending generally downwardly along the opposing lateral sides 21L, 21R of the chassis 20 and housing 22. In the preferred embodiment, the rider 80 is fixed to the vehicle chassis 20 at least four locations. The arms 84 extend generally frontwardly such that the hands 86 grasp handlebars 29. In the preferred embodiment, the hands 86 are fixed to the handlebar 29. Although the feet 90 may include a screw and socket assembly or a ball and socket joint for pivotable engagement with the central housing 22 or drive mechanism housing 40, in the preferred embodiment, the feet 90 of the rider 80 are simply fixed with or to the drive mechanism housing 40. Additionally, the rider 80 may be fixed via threaded fasteners or other conventional forms of fastening to the top of the central housing 22.

Alternatively, the rider 80 may be articulated at various locations. For example, the joints formed between the torso 81 and the arms 84 may be constructed such that the rider 80 may shift from side to side with relatively little if any resistance. Furthermore, a joint may be formed between the torso 81 and the mid-section 83 so that the torso 81 and mid-section 83 could move relative to each other. In addition, joints formed between the legs 88 and the mid-section 83 could be constructed such that the legs 88 and mid-section 83 may move relative to each other. The rider 80 may be articulated at the joints described above so that the rider 80 may shift from side to side without resistance in the direction that the toy vehicle 10 leans. An alternative steering mechanism 600 (see FIG. 8) capable of producing selected side to side movement is described herein below.

Referring to FIG. 1, according to one aspect of the present invention, the knees or knee regions 89 of the legs 88 of the rider 80 may be shaped to provide skid surfaces 92 that look generally like knee pads 92' and are spaced outwardly from the sides of the housing 22. The skid surfaces 92 may be constructed of durable wearing material such as nylon or metal. In addition or in the alternative, rotating members 94 such as knee wheels 94' are rotatably attached to the knees at the skid surfaces 92 at least or generally in the knee regions 89 of the rider's legs such that the knee wheels 94' are exposed at the knee regions 89, which are the lowermost part of each leg 88 of the rider along each lateral side of the housing 22. One of ordinary skill in the art would recognize that other rotating members 94 could be substituted for the knee wheels 94' including rollers, ball bearings and the like. The legs 88 are designed in such a manner that the knee wheels 94' maintain the toy vehicle 10 on its main road wheels 24, 34 to prevent the toy vehicle 10 from tipping over. More particularly, knee wheels 94' are located sufficiently low and sufficiently outward from the lateral sides of the housing 22 that the knee wheels 94' maintain the vehicle 10 upright in an extreme leaning position on a generally horizontal surface, preferably even while the vehicle 10 is stationary. An extreme leaning position is one in which one of the knee wheels 94' or other rotating member and the tires of each of the front and rear wheels are simultaneously in contact with the surface S supporting the toy vehicle 10, as is depicted in FIG. 7. When the toy vehicle 10 is in its extreme leaning position while in a turning motion on its side, the knee wheel 94' on the turning side of the vehicle 10 contacts and rotates along the support surface S with the tires 25, 35 of the front and rear wheels 24, 34. The knee wheels 94' are generally vertical and could have diametric planes parallel to the central vertical longitudinal plane of the vehicle 10 (i.e. a plane parallel to the plane of FIG. 2). Preferably, they are tilted inwardly at their top ends (as depicted in FIG. 7) so that each is vertical when supporting the toy vehicle 10 in an extreme leaning position. If desired, the knee wheels 94' may also be tilted outwardly (or inwardly) at their front ends (not depicted) so as to track a curving path when supporting the vehicle 10 in an extreme leaning position. Alternatively, the toy vehicle 10 may have "wings" (not depicted) extending outwardly from the opposite lateral sides of the vehicle chassis 20, with or without rotating support members to support or further support the toy vehicle 10 during a turn or while at rest.

Figure 5:
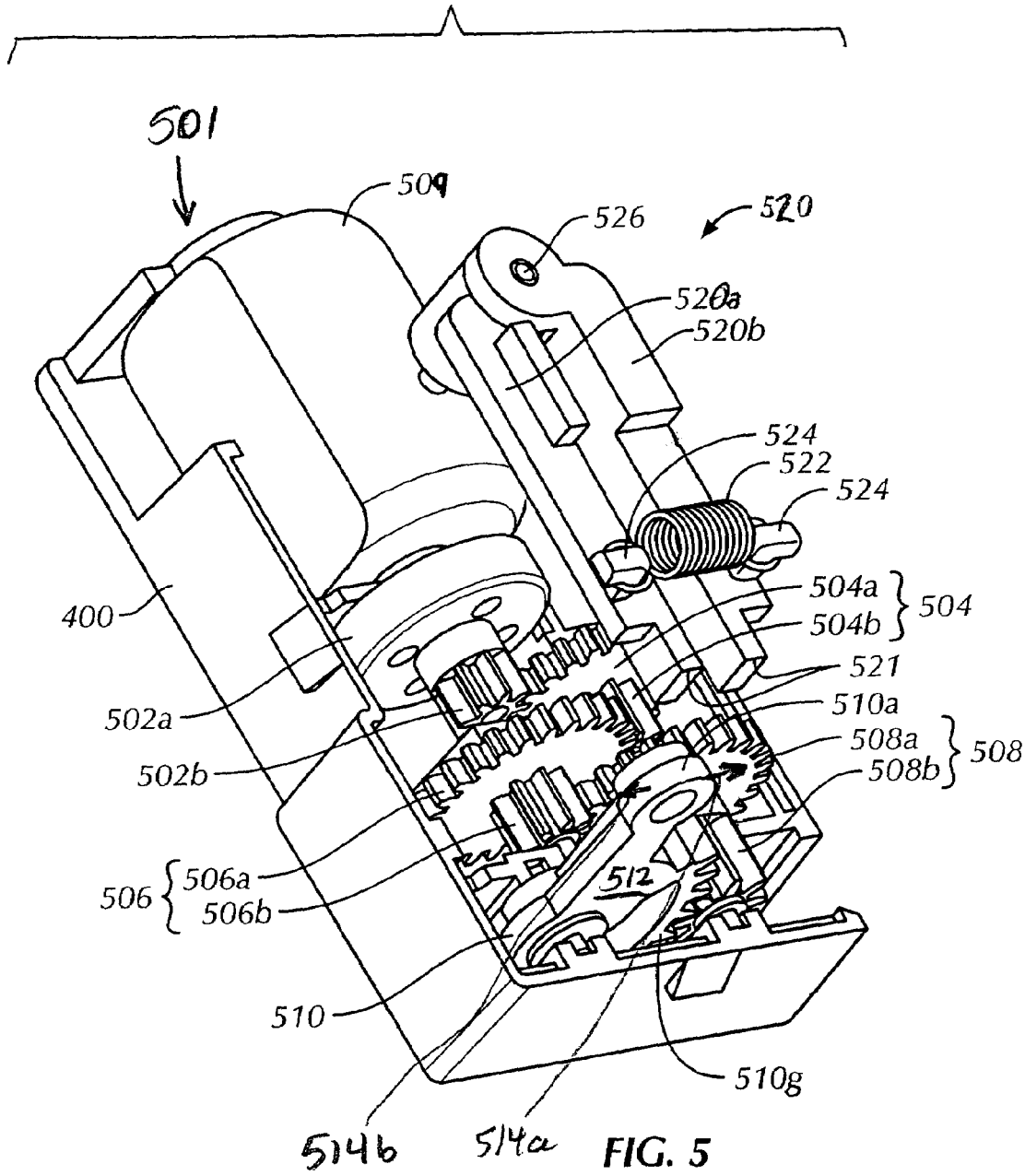
FIG. 5 is a right side perspective view of the steering mechanism of FIG. 4 shown without on-half of a steering mechanism housing.

Referring to presently preferred a steering mechanism indicated generally at 500 is used to pivot the fork 28 and the front wheel 24 about a generally vertical axis 28' in order to steer the toy vehicle 10. The steering mechanism 500 preferably is located within the central housing 22 proximate the top, mid-portion, and is supported by the chassis and/or housing 22. Referring to FIG. 5, the steering mechanism 500 comprises a steering servo 501 formed by a conventional, high speed miniature motor 509 that rotatably drives a reduction gear train through a slip-clutch 502*a*. The slip-clutch 502*a* may be like that disclosed in U.S. Pat. No. 5,281,184, incorporated by reference herein, or any variation thereof. Directly beneath and fixed to the slip-clutch 502*a* is a slip-clutch pinion 502*b* that is fixed to and rotates with the slip-clutch 502*a*. The slip-clutch 502*a* permits the steering servo motor 509 to continues to rotate even after the rotation of the slip-clutch pinion 502*b* is halted or externally reversed. The slip-clutch pinion 502*b* meshes with a larger spur gear 504*a* of a first combination gear 504. The larger spur gear 504*a* is fixedly connected to and rotates with a first pinion 504*b*. The first pinion 504*b* is meshed with a larger spur gear 506*a* of a second combination gear 506 located directly beneath the slip-clutch pinion 502*b*. A second pinion 506*b* is fixedly connected to and directly beneath the second larger spur gear 506*a* so as to rotate with the second spur gear 506*a*. The second pinion 506*b* meshes with a directly adjacent third larger spur gear 508*a* of a third combination gear 508. The third larger spur gear 508*a* is fixedly connected to and rotates with a third pinion 508*b* that is directly beneath third spur gear 508*a*. Torque is further transferred by the third pinion 508*b* to rotate a first steering pin 510 in either a first or second direction from a centered or neutral position depicted in FIG. 5 through engagement of the third pinion 508*b* with a sector gear 510*g* from which the pin 510 extends and is supported. The preferred steering pin 510 includes a first ring 510*a* at its distal tip. The steering servo 501 including the motor 509, the slip clutch 502 and the plurality of gears 504, 506, 508, 510*g*, are housed within a steering mechanism housing 400 within the main housing 20.

Figure 4:
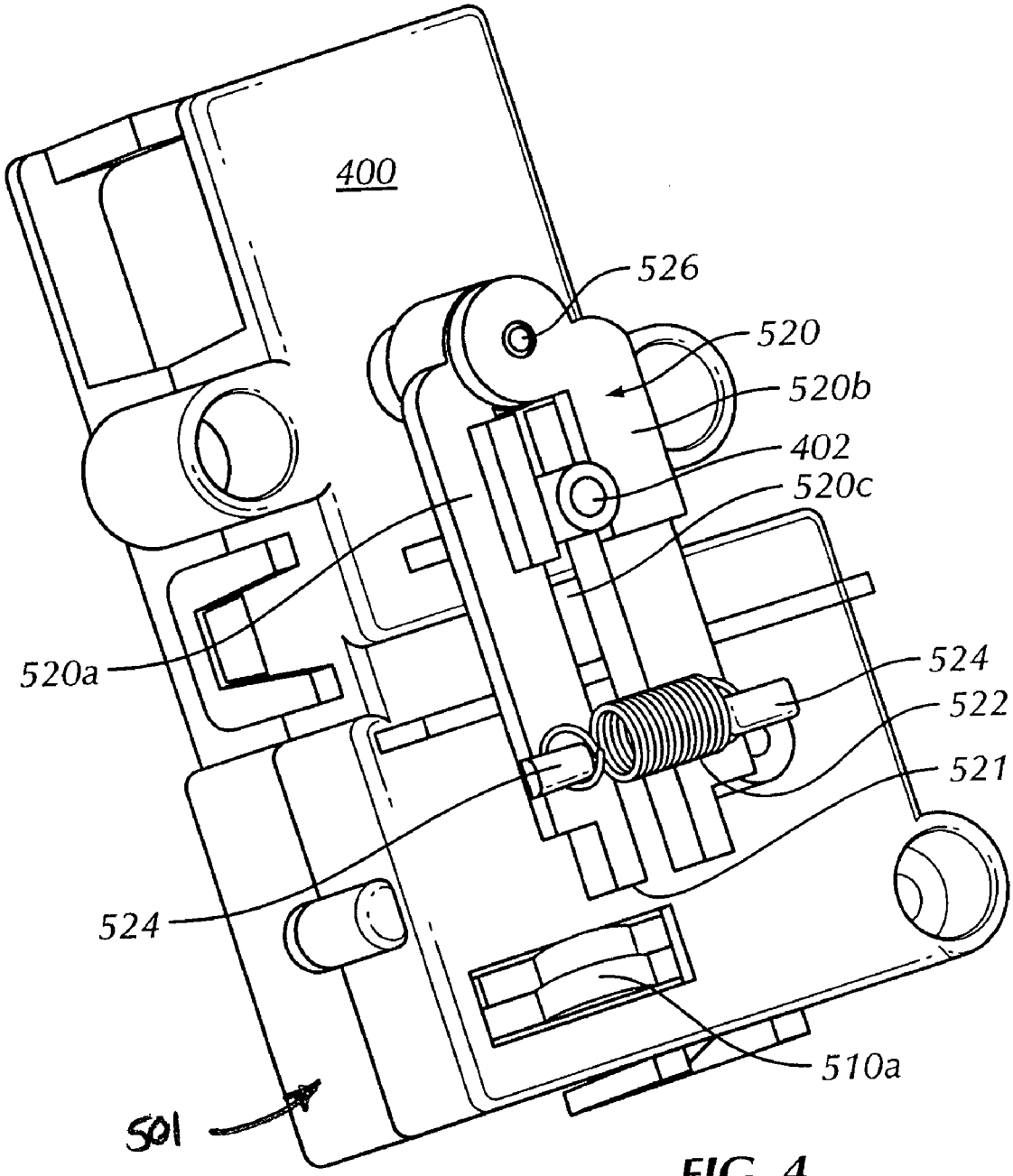
FIG. 4 is a right side perspective view of the steering mechanism of FIG. 3 shown without a push/pull bar.

Referring to FIG. 4, a centering adjustment indicated generally at 520 has a first arm 520*a* and a second arm 520*b* each pivotably connected by a pin 526 to the top portion of the steering mechanism housing 400. The first and second arms 520*a*, 520*b* include hooks 524 extending in opposite longitudinal directions and located near distal ends 521 of the first and second arms 520*a*, 520*b*. A first post 402 extends from the steering mechanism housing 400 to create space 520*c* between the first and second arms 520*a*, 520*b*. A coil spring 522 connects the hooks 524 to maintain a general parallel configuration of the first and second arms 520*a*, 520*b* against post 402. Operation of the centering adjustment 520 is described herein below.

Figure 3:
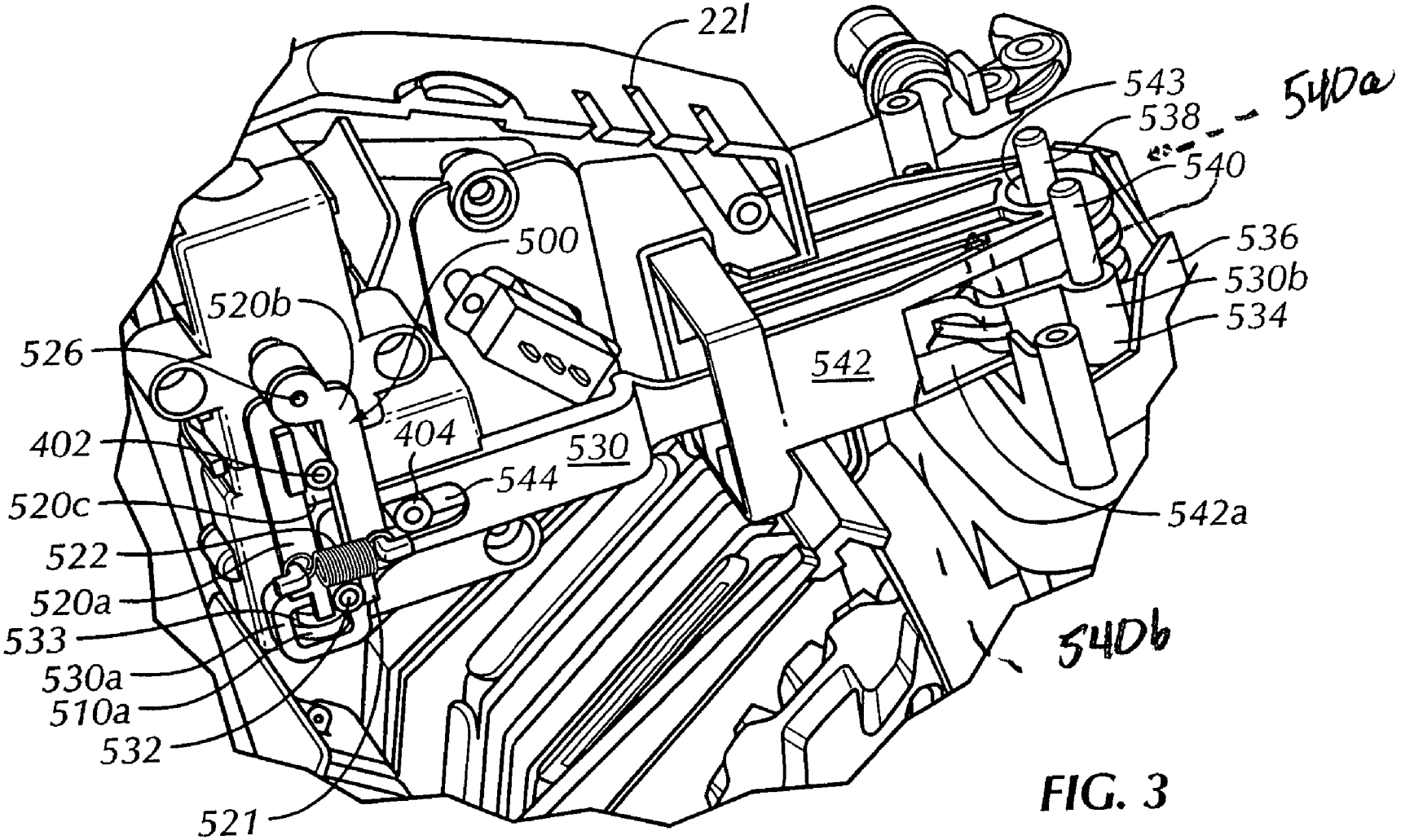
FIG. 3 is a right side perspective view of a steering mechanism of the toy vehicle of FIG. 1.

Referring to FIG. 3, a push/pull arm 530 having a first end 530*a* and a second end 530*b* extends generally in a front-to-back position of the toy vehicle 10. The push/pull arm 530' is operably coupled with the fork 28 and to the servo 501 in a manner to be described for selective linear movement from a centered or neutral steering position indicated in solid in FIGS. 2-3 to a push position 540*a* (in phantom in FIG. 3) and from the centered position to a pull position 540*b* (also in phantom in FIG. 3). At or near the push bar first end 530*a* is a pin 532 that fits within space 520*c* between the first and second arms 520*a*, 520*b* at or near the distal ends 521. The first end of the push bar 530*a* also includes a slot 533 substantially similar in size with the steering pin ring 510*a* to receive the ring 510*a*. The steering mechanism housing 400 includes a second post 404 that extends through a slot 544 of the push/pull arm 530. The slot 544 is sized such that it is capable of free linear travel around the second post 404. The push/pull arm 530 extends through an open end of a pivot support 542 and the push bar second end 530*b* extends through a pivot support side opening 542*a*. A second ring 534 located on the push bar second end 530*b* receives a push bar hinge pin 540 that extends fixedly from a fork plate 536 forming the top portion of the front wheel fork 28. The pivot support 542 includes a cylindrical opening 543 that rotatably receives a steering hinge pin 538 which extends from the fork plate 536 and fixedly couples together the fork plate 536 and fork 28. The pivot support 542 is further fixed and stabilized to the chassis 20 and housing 22 so as to rotatably support the front wheel fork 28 and fork plate 536 through pin 538 and pivotally couple the front wheel fork 28 to the chassis 20 and housing steer the toy vehicle 10 through the front wheel 24. The push bar hinge pin 540 is laterally offset from the steering hinge pin 538 on which the front fork 28 rotates with respect to the chassis 20. An imaginary line extending between the pins 538, 540 is substantially perpendicular to the push/pull arm 530 on the centered/neutral straight ahead position of the front wheel 24 and fork 28 so that forward/rearward movement of the push bar hinge pin 540 transfers maximum torque into rotation of the front wheel fork 28 about the steering hinge pin 538. The steering hinge pin 538 is fixedly connected to the fork plate 536 parallel to and at or near the center of the fork 28. In the preferred embodiment, the push bar hinge pin 540 and the steering hinge pin 538 are constructed of a solid metal. Furthermore, the push/pull arm 530 and related components are constructed of a polymer. One of ordinary skill in the art would recognize that other materials could be substituted for the hinges pins 538, 540, the push/pull arm 530 and related components so long as the strength and overall weight of the toy vehicle 10 is not compromised. Alternatively, the fork plate 536 connecting the hinges pins 538, 540 may be replaced by a softer, spring connection (not depicted).

The toy vehicle 10 is provided with a propulsion or drive mechanism indicated (in phantom) generally at 38 disposed within the drive mechanism housing 40. Preferably, the drive mechanism 38 is identical to that disclosed in U.S. patent application Ser. No. 11/056,341, "Remote-Controlled Toy Vehicle Having Multi-Mode Drive Mechanism", filed Feb. 11, 2005, and incorporated by reference herein in its entirety. Mechanism 38 includes a drive or propulsion motor 42 and a drive train indicted generally at 44 (in phantom) operably, drivingly coupling the motor 42 with the rear wheel 34, either directly or through axle 36. Alternatively, other conventional toy vehicle drive mechanisms could be used. The drive mechanism imparts rotation to the rear wheel 34 in order to drive the toy vehicle 10 in a forward direction.

Referring now to FIG. 6, an exemplary, manually operated, remote controller 100 has a pistol grip handle 100*a* which is grasped by a user. The controller 100 is used by the user to remotely control the movement of the toy vehicle 10. The controller 100 has bi-directional trigger 104, which preferably controls the forward motion of the toy vehicle 10, and a rotational knob 102, which preferably controls the steering of the toy vehicle 10. The controller 100 also includes buttons 108, which can be used to control other aspects of the toy vehicle 10, such as lighting and production of sound effects from a speaker (not shown) disposed within the toy vehicle 10. The controller 100 further has an antenna 106 extending upwardly from the top of the controller 100. The controller 100 is preferably powered using batteries (not shown) located within the handle 100*a*. One of ordinary skill in the art would recognize that other controllers with different shapes and functions could be used so long as the toy vehicle 10 can be properly driven.

Referring again to FIG. 2, a conventional on-board control unit 110 is mounted to and maintained within the housing 22 of the toy vehicle 10. An antenna (not shown) is electrically coupled to the on-board control unit and is disposed at least partially within the housing 22 or the rider 80 so as not to protrude from the toy vehicle 10. Also, a battery power supply 112 is removably engaged within the housing 22 at its bottom portion to power the toy vehicle 10. Preferably, the battery power supply is a rechargeable direct current battery or battery pack. A flexible battery pack, such as that disclosed in U.S. Pat. No. 5,853,915, incorporated by reference herein in its entirety, may be used. Preferably, a battery pack having a driving current of less than 3 amps is used. Although this is preferred, it is within the spirit and scope of the present invention that the toy vehicle 10 be powered by another type of battery or electric power source such as a quick charge capacitor. The vehicle can be powered by a non-electrical source, such as air or gasoline, but either means must be provided to reverse the output of such power source or such power source has to drive a generator to drive a reversible electric motor. The battery power supply is located on the bottom of chassis 20 to lower the center of gravity ("CG" in FIG. 7) as low as possible. Preferably, the CG is located along the central vertical longitudinal plane 12 at or below a horizontal plane 96 connecting lowermost edges of the rotating members 94.

The on-board control unit indicated generally at 110 is electrically and operably coupled with the steering servo 501 and a drive motor 42 through standard control circuits that controllably couple the battery power supply with the steering servo motor 501 and the propulsion or drive motor 42 and is configured to receive and process control signals transmitted from the manually operated, remote controller 100 to remotely control itinerant movement of the toy vehicle 10 by the user. The user is able to remotely control the drive motor to either rotate in the first drive direction (by moving the trigger 104 in a first direction), thereby propelling the toy vehicle 10 in the forward direction. The user will also be able to remotely control the steering servo 501 to pivot the front wheel 24 in either a first or a second steering direction so as to turn the toy vehicle either right or left by turning the rotational knob 102 in the programmed direction.

The toy vehicle 10 is preferably bottom weighted with the battery power supply 112 located at the very bottom of the housing 22 and dimensioned so that the center of gravity is located between the road wheels 23, 34 and the knee wheels 92' in any leaned over position of the toy vehicle 10. This assures that when the toy vehicle 10 falls or rolls over or is simply placed down on its wheels, the toy vehicle 10 is supported on one of its lateral sides on its two tires 25, 35 and one of the skid pad knee wheels 94'. In operation, the toy vehicle 10 is driven forward from such an initial position. As user inputs a forward command from the transmitter 100, the rear wheel drive motor (not shown) is activated to rotate the rear wheel 34. The toy vehicle 10 begins to move to its upright position as the toy vehicle 10 picks up speed. To make a turn, a user further engages the remote control transmitter 100 and inputs a turn command in the normal manner through knob 102 whereby the steering servo 501 is activated to turn the vehicle.

Preferably, the on-board control unit is 110 is programmed such that to make a left turn, the steering servo 501 is activated from a neutral position 512 (in solid in FIGS. 3-5) and the slip-clutch 502*a* is initially rotated clockwise, when viewed from the top of the toy vehicle 10, causing the steering pin 510 and push/pull arm 530 to move in a backward direction 514*b* to a pull position 540*b*. Backward movement of the push/pull arm 530 causes the pin 532 to displace the first arm 520*a* backward and to thereby pull the front wheel 24 from an original straight direction 50 to a right turn/right facing direction 54, the opposite direction to the user commanded direction. The pin 510 and push/pull arm 530 are held in the pull position for a first predetermined time period, preferably less than one second, sufficient to destabilizes the toy vehicle 10 which begins to fall away to the left due to the weight shift of the rider 80 and of the toy vehicle 10 as the front wheel moves away from a momentum vector of the vehicle 10. The preferred on-board control unit is 110 is programmed to then automatically reverse the direction of rotation of the steering motor 509 and direction of the steering servo 501 causing the push/pull arm 530 to move in a forward direction 514*a* to a push position 540*a*. Forward movement of the push/pull arm 530 causes the crank pin 532 to displace the second arm 520*b* forward and the front wheel 24 to be pushed to a left facing/left turn direction 52. The front wheel 24 selectively remains turned left for a second time period longer that the first time period in order to actually make the turn and so long as the rotational knob 102 of the remote controller 100 is manually engaged by the user. When the rotational knob 102 is selectively released by the user, power to the servo 501 is cut by the control unit 110 and the natural force of the spring 522 returns the centering adjustment 520 to a neutral position where the first and second arms 520*a*, 520*b* are parallel to each other. Thus, the front wheel 24 and fork 26 are returned to the original straight position 50. If the user engages the rotational knob 102 for less than one second, the on-board control is preferably configured to turn the front wheel 24 to the right (taking the above example) for no more than the predetermined period (less than one second) and then allow the servo to return to the neutral position and the front wheel to return to the original straight direction. The motorcycle 10 should shutter but continue in a straight ahead direction.

Thus, a method of steering a toy motorcycle having in-line front and rear wheels 24, 34 to simulate counter-steering comprises a step of actuating a steering servo 501 on the toy motorcycle 10 so as to turn one of the front wheel 24 and the rear wheel 34 of the toy motorcycle 10 initially from an original straight direction to a first direction and maintaining the one wheel 24, 34 in the first direction for less than one second so as to initially destabilize the toy motorcycle 10. Immediately thereafter, the steering servo 501 is automatically actuated to turn the one wheel 24, 34 from the first direction to a second direction laterally opposite the first direction. The one wheel 24, 34 is maintained in the second direction for a period greater than one second, sufficient to turn the motorcycle from the originally straight direction to the second direction. Preferably, the steering servo 501 is selectively operated to turn the one wheel 24, 34 from the second direction back to the original straight direction when the rotational knob 102 on the remote controller 100 is released.

With reference now to FIG. 8, an alternative steering mechanism 600 for simultaneously steering the front wheel 24 and shifting the rider FIG. 80 from side-to-side is shown. The alternative steering mechanism 600 comprises a conventional steering servo (indicated generally at 610) that rotatably drives a crank wheel or "crank" 612. The crank 612 includes a first crank pin 614 that extends substantially perpendicular from the surface of the crank 612. A forward portion of the steering mechanism is generally similar to the first embodiment steering mechanism 500 described above. In particular, the forward portion of the steering mechanism 600 controls the steering of the front wheel 24. The first crank pin 614 rests within a push bar pin bracket 632 located proximate a first end of a push bar 630. The push bar 630 extends toward the front end of the toy vehicle 10 and terminates at a second end where the push bar 630 connects to a push bar hinge pin 638. The push bar hinge pin 638 is fixedly connected to and laterally offset from a steering hinge pin 640 on which the front fork 28 rotates with respect to the body. An imaginary line extending between the pins 638, 640 is substantially perpendicular to the push bar 630 so that movement of the push bar hinge pin 638 directly transfers rotation to the steering hinge pin 640 via a rigid link 642. The steering hinge pin 640 is fixedly connected to the fork 28 parallel to and at or near the center of the fork 28 to rotate the fork. Alternatively, the rigid link 642 connecting the hinges pins 638, 640 may be replaced by a softer spring connection (not depicted).

With continued reference to FIG. 8, with respect to a rear portion of the alternative steering mechanism 600 which controls side to side movement of the rider 80, a second crank pin 616 extends from the crank 612. A vertical moving lever 650 having a first lever pin bracket 652 is operably receives the second crank pin 616 and extends toward the rear of the toy vehicle 10. One end of a rotating lever 660 extends in a lateral direction of the toy vehicle 10 and is captured within a second lever pin bracket 654 connected to the vertical lever 650. Another end of the rotating lever 660 is fixedly attached to a rider actuation rod 670. The rider actuation rod 670 connects to the rider FIG. 80.

In operation, the alternative steering mechanism 600 is configured for direct steering. To make a left turn, the steering servo 610 is activated from a neutral position and the crank 612 is rotated counterclockwise, when viewed from the right side of the toy vehicle 10 (as in FIG. 8), causing the push bar 630 to move forward. The forward motion of the push bar 630 causes the push bar hinge pin 638 to move in a forward direction. Rotational force is thus transferred to the front fork 28 via the rigid link 642 transferring torque to steering hinge pin 640. This causes the fork 28 to rotate counter-clockwise on pin 640, when viewed from the top, and the front tire 25 to rotate in the left turn direction. Simultaneously, the counterclockwise rotation of the crank pin 616 causes a downward movement of the vertical lever 650, and subsequent clockwise rotation (viewed aft looking forward) of the rotating lever 660. The rider actuation rod 670 is rotated clockwise, (viewed from the rear of the toy vehicle 10), causing the rider 80 to shift to the right. Similarly, a right hand turn is initiated by activating the steering servo to rotate the crank 612 clockwise. If desired, the linkages can be changed to move the rider in the same direction as the front wheel, for example, by pivotally supporting lever 650 between in 616 and lever 660. Alternatively, the rear portion of the alternative steering mechanism can be omitted and articulated rider 80 can be coupled to the vehicle 10 so as to be only at its hands and feet are free to shift from side to side as the vehicle 10 leans.

A remote-controlled toy motorcycle is thus disclosed providing a durable rolling element to contact a supporting surface with the toy motorcycle in an extreme leaning position, allowing the toy motorcycle to self-start from the extreme leaning position. Furthermore, a method of steering a toy vehicle which simulates counter-steering is also disclosed.

It will be appreciated by those skilled in the art that changes could be made to the embodiment described above without departing from the broad inventive concept thereof. For example, control unit 100 might be a microprocessor, a microcomputer, a processor portion of a sound production chip or an application specific integrated circuit. It is understood, therefore, that this invention is not limited to the particular embodiments disclosed, but it is intended to cover foreseeable modifications within the spirit and scope of the present invention as defined by the appended claims.

We claim:

1. A method of steering a toy vehicle having in-line front and rear wheels to simulate counter-steering in turning from an original straight direction to a direction away from the straight direction comprising the steps:

a) actuating a steering servo on the toy vehicle so as to turn one of the front wheel and the rear wheel of the toy vehicle initially from an original straight direction to a first direction and maintaining the one wheel in the first direction for a first time period sufficient to initially destabilize the toy vehicle; and b) immediately thereafter automatically actuating the steering servo to turn the one wheel from the first direction to a second direction laterally opposite the first direction and maintaining the one wheel in the second direction for a second time period greater than the first time period and sufficient to turn the toy vehicle from the originally straight direction to the second direction.

2. The method of claim 1 wherein the first time period for performing step a) is less than one second and the second time period for performing step b) is more than one second.

3. The method of claim 2 further comprising a step:

c) after steps a) and b), selectively operating the steering servo so as to turn the one wheel from the second direction back to the original straight direction.

4. The method of claim 1 wherein the steps a) and b) are performed in response to a command from a source remote from the toy vehicle to turn the toy vehicle in the second direction.

5. The method of claim 1 further comprising before actuating steps a) and b), a preliminary step of transmitting to the toy vehicle from a location remote to the toy vehicle, a turning command signal directing the toy vehicle to turn in the second direction and wherein both actuating steps a) and b) are performed automatically in sequence in response to receiving the turning command signal by the toy vehicle.

6. A method of steering a toy vehicle having in-line front and rear wheels to simulate counter-steering in turning from an original straight ahead travel direction in which the in line front and rear wheels are parallel to one another and the straight ahead travel direction to a travel direction away from the original straight ahead travel direction comprising the steps:

a) actuating a steering servo on the toy vehicle in a first direction of the steering servo away from an initial position of the steering servo maintaining the toy vehicle in the original straight ahead travel direction so as to turn one of the front wheel and the rear wheel of the toy vehicle initially from the original straight ahead travel direction of the toy vehicle to a first travel direction away from the original straight ahead travel direction and maintaining the one wheel in the first travel direction for a first time period sufficient to initially destabilize the toy vehicle; and b) immediately thereafter automatically actuating the steering servo to move in a second direction away from the initial position of the steering servo and opposite the first direction of the steering servo so as to turn the one wheel from the first travel direction to a second travel direction laterally opposite the first travel direction and away from the original straight ahead travel direction and maintaining the one wheel in the second travel direction with the steering servo for a second time period greater than the first time period and sufficient to turn the toy vehicle from the originally straight ahead travel direction in the second travel direction.

7. The method of claim 6 further comprising a step:

c) after steps a) and b), selectively returning the steering servo back to the initial position of the steering servo to turn the one wheel from the second direction to a new straight ahead travel direction different from the original travel direction and again parallel with the in line front and rear wheels.

* * * * *